United States Patent [19]

Takayama et al.

[11] 4,082,681

[45] Apr. 4, 1978

[54] MAGNETIC DEVELOPER FOR ELECTROSTATIC PHOTOGRAPHY AND PROCESS FOR PREPARATION THEREOF

[75] Inventors: Hiroshi Takayama, Moriguchi; Tatsuo Aizawa, Osaka, both of Japan

[73] Assignee: Mita Industrial Company, Osaka, Japan

[21] Appl. No.: 628,823

[22] Filed: Nov. 4, 1975

[51] Int. Cl.[2] ..... G03G 9/08; G03G 9/14

[52] U.S. Cl. ..... 252/62.1 P; 96/1 SD; 252/62.55; 252/62.54; 252/511; 252/512; 252/514; 427/18; 427/222

[58] Field of Search ..... 252/62.1 P, 62.54, 62.53, 252/500, 511, 512, 514; 427/18, 222; 96/1 SD

[56] References Cited

U.S. PATENT DOCUMENTS

| | | | |
|---|---|---|---|
| 2,919,247 | 12/1959 | Allen | 252/62.1 P |
| 3,042,616 | 7/1962 | Brown | 252/62.53 |
| 3,239,465 | 3/1966 | Rheinfrank | 252/62.1 P |
| 3,485,758 | 12/1969 | Borucki et al. | 252/62.54 |
| 3,520,811 | 7/1970 | Swoboda | 252/62.1 P |
| 3,627,682 | 12/1971 | Hall et al. | 252/62.54 |
| 3,639,245 | 2/1972 | Nelson | 252/62.1 P |
| 3,925,219 | 12/1975 | Strong | 252/62.1 P |

*Primary Examiner*—Ronald H. Smith
*Assistant Examiner*—John D. Smith
*Attorney, Agent, or Firm*—Sherman & Shalloway

[57] ABSTRACT

A developer for electrostatic photography comprising as indispensable components a fine powder of a magnetic material and a binder resin, said developer consisting essentially of a dry blend of (A) substantially spherical particles of a composition comprising a medium of said binder resin and said fine powder dispersed in the binder resin medium and (B) a finely divided solid conducting agent having a particle size smaller than 1/10 of the size of the spherical particles (A), said spherical particles (A) having a crater-like rough surface, said finely divided solid conducting agent (B) being stuck to said spherical particles (A) through said crater-like rough surfaces thereof, and the volume resistivity of said dry blend being not higher than $1 \times 10^{11}$ Ω-cm.

21 Claims, No Drawings

MAGNETIC DEVELOPER FOR ELECTROSTATIC PHOTOGRAPHY AND PROCESS FOR PREPARATION THEREOF

This invention relates to a developer for electrostatic photography and to a process for the preparation thereof. More particularly, the invention relates to a developer for electrostatic photography excellent in electric and magnetic characteristics which comprises a dry blend of spherical particles containing a finely divided magnetic material and having a crater-like rough surface and a finely divided conducting agent, and to a process for the preparation of this developer for electrostatic photography.

Known developers of the dry type (toners) heretofore used for developing electrostatic latent images formed by electrostatic photography or the like include so-called magnetic toners capable of performing development without the aid of a particular carrier. These magnetic toners are generally prepared by dispersing the powder of a magnetic material such as triiron tetroxide, if necessary with additives such as a pigment, into a medium of a binder resin and molding the dispersion into granules. In order to improve the conductivity in these magnetic toners, these has generally been adopted a method in which the amount of a conductive component is increased in the above dispersion to be molded into particles or a method in which a conductive substance such as carbon black is embedded in the resulting granular product to thereby form particles having a conductivity imparted to the surfaces thereof and having such a property that the particles as a whole can be magnetically attractable.

These magnetic toners have the advantage that clear toner images with a much reduced edge effect can be produced according to the magnetic brush development method without using a magnetic carrier or the like. However, the production of these magnetic toners involves various difficulties. More specifically, the known process for the production of magnetic toners involves complicated steps of uniformly dispersing powder of a magnetic material, optionally with a pigment such as carbon black, into a melt of a binder resin medium, cooling and finely pulverizing the molten mixture, and molding the pulverized mixture into fine particles under the application of heat. Further, magnetic toner particles prepared according to this conventional process have a very broad particle size distribution range. When magnetic toners containing particles of a large size are employed, the resolving power is low in developed copies, and when magnetic toners containing particles of an extremely small size are employed, so-called fog is caused on development. Accordingly, in the magnetic toners prepared according to the conventional process, the particle size should inevitably be adjusted by sieving or the like, resulting in reduction of the yields of toners.

In one type of the above-mentioned known magnetic toners, a powdery magnetic material or particulate carbon black or the like is coated with an electrically insulating resin, and the toner of this type is poor in conductivity and provides only copied images with a high edge effect. Accordingly, in another type of the known magnetic toners, in order to overcome this defect, there is adopted a complicated operation of embedding particles of a conductive substance such as carbon black completely into surfaces of the toner particles.

In accordance with this invention, there is provided a developer for electrostatic photography which is quite different from the foregoing known magnetic toners in the detailed structure and properties of the particles. More specifically, the developer for electrostatic photography according to the present invention comprises as indispensable components a fine powder of a magnetic material and a binder resin, and it is characterized in that it is made up of a dry blend of (A) substantially spherical particles of a composition comprising a medium of said binder resin and said fine powder dispersed in the binder resin medium and (B) a finely divided solid conducting agent having a particle size smaller than 1/10 of the size of the spherical particles (A). Since the fine powder of the magnetic material is predominantly distributed in the surface layer portion of each spherical particle, the spherical particles (A) have a crater-like rough surface ( this fact is confirmed by a high oil absorption and from a microscopic photograph ). Because of this novel structural feature, the spherical particles (A) have a sufficient anchoring effect to the fine powder (B) of the magnetic material dry-blended in the spherical particles (A).

In magnetic toners prepared by merely dry-blending a known magnetic material with carbon black, it is apprehended that at the step of forming electrostatic latent images, carbon particles separated from the magnetic toner will adhere to the background to degrade the clearness of formed copies. For this reason, in conventional magnetic toners, there is adopted a complicated operation of embedding carbon black in the surface portion of the magnetic toner. In contrast, in the present invention, even when the above-mentioned spherical particles are merely dry-blended with carbon black and the dry blend is applied to a photosensitive layer having an electrostatic latent image formed thereon, as is apparent from Example 1 given hereinafter, no contamination is caused on the background and bleeding of the toner image is greatly reduced. This fact is quite surprising. We believe that the attainment of this unexpected effect is due to the fact that spherical particles (A) in the developer of the present invention have the above-mentioned peculiar surface and fine particles (B) of a conducting agent such as carbon black adhering to the spherical particles (A) are hardly disconnected from the spherical particles at the development step. In the developer of the present invention, as pointed out hereinabove, the dry-blended fine powder (B) of the solid conducting agent is anchored on the surface portion of the spherical particles (A), and therefore, the developer of the present invention has a relatively low volume resistivity suitable for application as magnetic toners, namely a volume resistivity lower than $1 \times 10^{+11}\,\Omega$-cm. Moreover, because of the structural feature that the fine powder (B) of the magnetic material is predominantly distributed in the surface layer of each spherical particle (A), the developer of the present invention is highly improved in the property of being attracted by a magnetic force.

The developer for electrostatic photography according to the present invention can easily be fixed on a copying paper by customary heat-fixing means, and it has the novel characteristic that it can readily be fixed on a copying paper under a relatively low pressure. More specifically, since in the present developer the spherical particles (A) have a crater-like rough surface and a layer of the dry-blended fine powder (B) of the conducting agent is present on the surface of the spherical particles (A), the developer of the present invention has a sufficient anchoring effect to a photosensitive layer or coating of a copying paper even under a relatively low pressure. Moreover, since the fine powder of the magnetic material is predominantly distributed in the surface layer portion of each spherical particle (A), a relatively large void is present in each spherical particle and the developer of the present invention has such a specific property that it can readily be broken and ground. Because of this characteristic, it is readily embedded in the broken and ground state into the photosensitive layer or coating of a copying paper under the application of pressure at the fixing step and hence, a strongly fixed image is readily formed on the copying paper.

The feature of the developer of the present invention that the spherical particles (A) have a crater-like rough surface and the fine powder (B) of a conducting agent such as carbon black is sprinkled on this rough surface provide prominent effects also in the heat-fixing step. More specifically, although the resin in a magnetic toner comprising a powdery magnetic material uniformly dispersed in a medium of a binder resin rises to the surface of a toner image in the heat-fixing step to provide an appearance which is shining to some extent, because of the above feature of the present developer an image formed by using the present developer has a soft appearance which is delustered to some extent and the tendency of prints to impart fatigue to the eyes of users is drastically reduced.

In accordance with the present invention, the novel developer for electrostatic photography having the above-mentioned various advantages is prepared by a process comprising mixing a powdery magnetic material with a binder resin dissolved or dispersed in a liquid mixture of a water-miscible organic solvent and a water-immiscible organic solvent; mixing the resulting mixture with an aqueous medium under strong shearing agitation sufficient to cause granulation of the mixture, thus transferring the organic solvents in the particulate mixture into the aqueous medium to thereby form substantially spherical particles having a crater-like rough surface; recovering the so formed particles; water-washing them according to need; drying the recovered particles under such conditions that the resin binder is not substantially molten; and dry-blending thereinto a finely divided solid conducting agent having substantially a particle size smaller than 1/10 of the size of said spherical particles.

The finely divided magnetic material has preferably a particle size smaller than 1000 m$\mu$, especially preferably a particle size smaller than 500 m$\mu$. It is also preferred that a finely divided magnetic material having a conductive property be used as such a finely divided magnetic material. In case the particle size of the finely divided magnetic material is larger than the above range, it becomes difficult to distribute the magnetic material predominantly in the surface layer of each spherical particle and to form a crater-like rough surface on the spherical particle. Therefore, the intended objects of the present invention cannot be attained by the use of such magnetic material having a large particle size.

As inorganic magnetic materials heretofore used in this field, there can be mentioned, for example, triiron tetroxide ($Fe_3O_4$), diiron trioxide ($\gamma$-$Fe_2O_3$), zinc iron oxide ($ZnFe_2O_4$), ytterium iron oxide ($Y_3Fe_5O_{12}$), cadmium iron oxide ($CdFe_2O_4$), copper iron oxide ($CuFe_2O_4$), lead iron oxide ($PbFe_{12}O_{19}$), nickel iron oxide ($NiFe_2O_4$), neodium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) and the like. In the present invention, at least one member selected from the foregoing magnetic materials is used, and use of triiron tetroxide as the magnetic material is especially preferred for attaining the intended objects of the present invention.

Any of the natural, semi-synthetic and synthetic resins and rubbers having suitable adhesiveness under the application of heat or pressure can be used as the resin binder in combination with the above-mentioned magnetic material. These resins may be thermoplastic resins, or uncured theremosetting resins or precondensates thereof. As valuable natural resins, there can be mentioned, for example, balsam, rosin, shellac, copal and the like. These natural resins may be modified with one or more of vinyl resins, acrylic resins, alkyd resins, phenolic resins, epoxy resins and oleoresins (oil resins) such as mentioned below. As the synthetic resin that can be used in the present invention, there can be mentioned, for example, vinyl resins such as vinyl chloride resins, vinylidene chloride resins, vinyl acetate resins and vinyl acetal resins, e.g., polyvinyl acetal; acrylic resins such as polyacrylic acid esters, polymethacrylic acid esters, acrylic acid copolymers and methacrylic acid copolymers, olefin resins such as polyethylene, polypropylene, polystyrene and styrene copolymers, polyamide resins such as nylon-12, nylon-6 and polymeric fatty acid-modified polyamides; polyesters such as polyethylene terephthalate/isophthalate and polytetramethylene terephthalate/isophthalate; alkyd resins such as phthalic acid resins and maleic acid resins; phenolformaldehyde resins; ketone resins, coumarone-indene resins; amino resins such as urea-formaldehyde resins and melamine-formaldehyde resins; and epoxy resins. These synthetic resins may be used in the form of mixtures, for example, a mixture of a phenolic resin and an epoxy resin, and a mixture of an amino resin and an epoxy resin.

As the natural and synthetic rubbers that can be used in the present invention, there can be mentioned, for example, natural rubber, chlorinated rubber, cyclized rubber, polyisobutylene, ethylene-propylene rubber (EPR), ethylene-propylene-diene rubber (EPDM), polybutadiene, butyl rubber, styrene-butadiene rubber (SBR), acrylonitrile-butadiene rubber and the like.

The binder resin to be used in the present invention should have a good solubility or dispersibility in a liquid mixture of a water-miscible organic solvent and a water-immiscible organic solvent, which will be detailed hereinafter.

In the present invention, the binder resin medium and the finely divided magnetic material can be mixed at various ratios, but in order to obtain a developer capable of attaining the foregoing objects, it is important that the finely divided magnetic material should be incorporated at such a ratio that the finely divided magnetic material is present in the resulting developer in an amount of 20 to 80% by weight, especially 40 to 60% by weight, based on the spherical particles (A). In case the amount of the finely divided magnetic material is less than 20% by weight, it is difficult to impart sufficiently to the spherical particles (A) the above-mentioned property of being magnetically attractable and the above-mentioned surface characteristic. When the amount of the finely divided magnetic material exceeds 80% by weight, the form-retaining property is often degraded in the resulting spherical particles (A).

In order to improve the color or hue of the spherical particles (A) and to extend the spherical particles (A), various dyes, pigments and extender pigments may be incorporated in the present invention. Suitable examples of these dyes, pigments and extender pigments are as follows:

Black Pigments:
Carbon black, acetylene black, lamp black and Aniline Black

Yellow Pigments:
Chrome yellow, zinc yellow, cadmium yellow, yellow iron oxide, Mineral Fast Yellow, nickel titanium yellow, Nablus Yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake Orange Pigments:
Chrome orange, molybdenum orange, Permanent Orange GTR, Pyrazolone Orange, Balkan Orange, Indanthrene Brilliant Orange RK, Benzidine Orange G and Indanthrene Brilliant Orange GK.

Red Pigments:
Red iron oxide, cadmium red, red lead, cadmium mercury sulfide, Permanent Red 4R, Lithol Red, Pyrazolone Red, Watchung Red calcium salt, Lake Red D, Brilliant Carmine 6B, Eosine Lake, Rhodamine Lake B, Alizarine Lake and Brilliant Carmine 3B Violet Pigments:
Manganese violet, Fast Violet B and Methyl Violet Lake Blue Pigments:
Ultramarine, cobalt blue, Alkali Blue Lake, Victoria Blue Lake, Phthalocyanine Blue, metal-free Phthalocyanine Blue, partially chlorinated Phthalocyanine Blue, Fast Sky Blue and Induthrene Blue BC.

Green Pigments:
Chrome Green, chromium oxide, Pigment Green B, Malachite Green Lake and Fanal Yellow Green G White Pigments:
Zinc flower, titanium oxide, antimony white and zinc sulfide Extender Pigments:
Baryte powder, barium carbonate, clay, silica, white carbon, talc and alumina white Dyes (basic, acidic, disperse and direct dyes):
Nigrosine, Methylene Blue, Rose Bengale, Quinoline Yellow and Ultramarine Blue.

It is preferred that these pigments and extender pigments have a particle size equal to or smaller than the size of the finely divided magnetic material, and that they be used in an amount smaller than 50% by weight, especially smaller than 10% by weight, based on the final composition.

In order to shape a composition of the finely divided magnetic material and the binder resin into substantially spherical particles and impart a crater-like rough surface to the resulting particles, it is important in the present invention that a mixture of a water-miscible organic solvent and a water-immiscible organic solvent should be used as the solvent for dissolving or dispersing therein the binder resin. When a water-miscible solvent such as lower alcohols is used alone, the shape is quite indefinite in the resulting particles, and when a water-immiscible solvent such as toluene is used alone, even though spherical particles may be formed, the production efficiency is very low and the particle size distribution is broadened and is skewed to the large particle size side. in contrast, when a mixture of a water-miscible organic solvent and a water-immiscible organic solvent is used according to the present invention, developers having the above-mentioned preferred properties can be prepared, which will readily be understood from the Examples given hereinafter.

As the water-miscible organic solvent, there can be mentioned, for example, lower alcohols such as methanol, ethanol and propanol; ketones such as acetone; ethers such as tetrahydrofuran and dioxane; amides such as N,N-dimethylformamide; amines such as morpholine and pyrrolidone; sulfoxides such as dimethylsulfoxide; and other polar organic solvents.

As the water-immiscible organic solvent, there can be mentioned, for example, aromatic hydrocarbons such as benzene, toluene and xylene; halogenated hydrocarbons such as chloroform, carbon tetrachloride, trichlene, perchlene and freon; esters such as ethyl acetate and amyl acetate; higher alcohols such as butanol; ethers such as n-butyl ether and ethyl ether; and ketones such as mesityl oxide and methylamyl ketone. These organic solvents may be used singly or in the form of mixtures of two or more.

The term "water-immiscible organic solvent" used in the present specification does not mean a solvent which is not dissolved in water at all, but a solvent which is slightly soluble in water can be used in the present invention conveniently. The difference between the water-miscible organic solvent and the water-immiscible solvent referred to in the present invention resides in that the former solvent is miscible with water at an optional ratio but the latter solvent does not possess such a property.

As the combination of such water-miscible and water-immiscible solvents especially suitable for attaining the objects of the present invention, there can be mentioned acetone/ethyl acetate; tetrahydrofuran/n-butanol; N,N-diemthylformamide/chloroform; acetone/benzene; tetrahydropyran/carbon tetrachloride/-benzene; and dioxane/ethyl acetate. Of course, combinations that can be used in the present invention are not limited to those exemplified above.

In the present invention, the mixing ratio of (a) a water-miscible organic solvent and (b) a water-immiscible solvent is changed depending on the kind of binder resin or the kinds of solvents used. However, in order to attain the intended objects of the present invention, it is generally preferred that both solvents (a) and (b) be used at a weight ratio (a):(b) ranging from 10:1 to 1:10, especially from 7:3 to 3:7. The concentration of the binder resin in such organic solvent [ $(a) + (b)$ ] is selected so that when the formed resin solution having the finely divided magnetic material dispersed therein is incorporated into water, spherical particles in which the finely divided magnetic material is predominantly distributed in the surface layer can be readily formed and a crater-like rough surface can be given to the respective particles. In view of the foregoing, in the present invention it is important that the resin concentration in the solvent solution should be 5 to 40% by weight, preferably 10 to 20% by weight.

According to the process of the present invention, the so formed solution or dispersion of the binder resin in a liquid mixture of the water-miscible and water-immiscible solvents is mixed with the above-mentioned amount of the finely divided magnetic material by known dispersing means, such as ultrasonic vibration, a homogenizer and a ball mill. Then, the resulting mixture is mixed under specific conditions detailed below. Namely, the mixing is conducted under strong shearing agitation sufficient to cause granulation in the mixture, so that sufficient centrifugal force and affinity of water can be applied to the formed particles of the mixture. In this mixing step, water forms a continuous dispersion medium and the resin-magnetic material mixture is present in the form of a spherical dispersoid. The finely divided material present in the spherical dispersoid undergoes the centrifugal force and affinity of water, whereby it is distributed predominantly in the surface portion of the dispersoid and a crater-like rough surface is formed. Simultaneously, the water-miscible organic solvent present in the mixture is transferred (eluted) into the water phase through the interface, and then, the water-immiscible organic solvent is removed from the spherical particles. It is believed that the binder resin-magnetic material mixture is formed into stabilized spherical particles having a desired detailed structure in the foregoing manner. In the present invention, it is also believed that while the finely divided magnetic material is distributed predominantly in the surface layer and a crater-like rough surface is formed, the use of the combination of a water-miscible organic solvent provides the effect of keeping the above mixture in a relatively flowable state and that after the elapse of a certain period of time, the mixture of the water-miscible and water-immiscible solvents has an action of fixing and stabilizing the attained partial distribution of the magnetic material and the formed rough surface. A finely divided magnetic material such as triiron teroxide has a higher affinity with an aqueous medium than with an organic solvent, and it is believed that by this property of the finely divided magnetic material, migration and partial distribution of the finely divided magnetic material into the surface layer and formation of a crater-like surface are promoted. The mechanism of the formation of novel spherical particles (A) of the developer of the present invention may be explained in the foregoing manner.

In the present invention, in order to apply strong shearing agitation to the system of the resin-magnetic material mixture and water and to apply sufficient centrifugal force to the resulting particles of the above mixture, it is generally preferred to use a high speed agitator provided with agitation vanes having a rotational speed of 1,000 to 6,000 rpm, especially 2,000 to 4,000 rpm. More specifically, when ultrasonic vibration or an ordinary low speed agitator is utilized for attaining the above objects, sufficient shearing force or centrifugal force cannot be applied to the binder resin-magnetic material mixture, and hence, it is difficult to form the above mixture into spherical particles. In case the rotational speed of the agitation vane is too great and exceeds the above-mentioned range, there are often caused such undesired phenomena as adhesion of bubbles to the spherical particles and formation of irregularly shaped particles. Therefore, the use of an agitator provided with agitation vanes rotated at a rotational speed within the above range is recommended in practising the process of the present invention.

The mixing ratio of the binder resin-magnetic material mixture slurry and water is selected so that the organic solvents in the slurry are readily transferred into the aqueous dispersion medium and the formed spherical particles do not adhere to one another but are independent from one another. In view of the foregoing, it is generally preferred that the aqueous medium be used in an amount at least 20 times the amount of the slurry, especially at least 40 times the amount of the slurry. Conditions for mixing the slurry with the aqueous medium are not particularly critical in the present invention. Namely, the mixing may be accomplished conveniently at room temperature and atmospheric pressure. If desired, it is possible to perform the mixing at an elevated temperature not exceeding the lowest temperature among the boiling point of water (100° C.) and the boiling points of the organic solvents used, or at a lowered temperature or under an elevated or reduced pressure.

The mixing of the binder resin-material mixture slurry and water may be accomplished batchwise by adding dropwise or gradually pouring the slurry into the aqueous medium. It is possible to perform the mixing in a continuous manner by pouring simultaneously the slurry and water into a vessel equipped with an agitator. In the former case, granulation and stabilization of the binder resin-magnetic material mixture are accomplished substantially instantaneously, for example, within 30 seconds. Accordingly, it is possible to stop agitation immediately after completion of the dropwise addition of the slurry. In the latter case, the formed spherical particles are withdrawn from the bottom of the vessel or overflowed from the vessel so that the residence time of the charged mixture in the vessel is about 10 seconds or longer.

The spherical particles (A) withdrawn from the high speed agitation device are washed wih water according to need and are then dried in vacuo or under atmospheric pressure. The drying conditions are selected so that the binder resin in the particles is not substantially melted.

The so prepared spherical particles (A) have a very high oil absorption because of the crater-like rough surface. For example, spherical particles prepared by melting and mixing a finely divided magnetic material and a binder resin and granulating the molten mixture have an oil absorption of 23.9. In contrast, the spherical particles (A) according to the present invention have an oil absorption of 45 to 90, especially 50 to 80, when measured with respect to the same particle size range.

The oil absorption referred to in the instant specification is determined in accordance with JIS K-5101 in the following manner:

A sample (10 g) is charged in a beaker, and purified linseed oil is gradually added dropwise to the sample. Every time a prescribed amount of linseed oil is added, the mixture is kneaded with a glass rod. This dropping and kneading operation is continued until the mixture is drawn upwardly in a rod-like form when the kneading rod is lifted up from the mixture and linseed oil is oozing out on the surface of the rod-like mixture. The oil absorption is calculated according to the following equation:

$$\text{Oil Absorption} = (A \times 100)/B$$

wherein A stands for the amount (g) of linseed oil added dropwise to the sample and B denotes the amount (g) of the sample.

According to the present invention, the so prepared spherical particles (A) having a crater-like surface are dry-blended with a finely divided solid conducting agent (B) having a particle size smaller than 1/10 of the size of the sphrical particles (A), and the solid conducting agent (B) is stuck to the spherical particles (A) through the crater-like rough surfaces thereof. By this step, the volume resistivity of the resulting dry blend is thus controlled below $1 \times 10^{11}$ Ω-cm.

As the finely divided conducting agent (B), there can be used, for example, carbon black, aluminum powder, copper powder, silver powder and the like. This finely divided conducting agent (g) is dry-blended in such an amount that the conducting agent (B) is stuck to the rough surfaces of the spherical particles (A) in an amount of up to 2% by weight, especially 0.1 to 2% by weight, based on the spherical particles (A).

The fact that in the developer of the present invention, though both the components (A) and (B) are merely dry-blended, the fine powder of the conducting agent (B) is hardly separated from the surfaces of the spherical particles (A) is readily understood from the Examples given hereinafter, which demonstrate that no contamination is caused on the background in the development step. Still further, the fact that the developer of the present invention consists essentially of a dry blend of both components (A) and (B) can be confirmed by the experimental result that when the developer of the present invention is subjected to water sieving using an aqueous medium containing a surface active agent, the spherical particles (A) can be separated from a dispersion of the finely divided conducting agent (B).

The developer of the present invention can be advantageously applied to various electrostatic photographic processes. For example, the developer of the present invention can be applied with ease in the form of a magnetic brush to an electrostatic image formed on a photoconductive layer of zinc oxide, CdS or the like. The toner image formed by development can easily be fixed under the application of heat and/or pressure as it is developed or after it has been transferred onto a suitable transfer paper.

The test method and apparatus used for determining the volume resistivity of the developer in the present invention will now be described.

Test Method

A sample developer is maintained in a region where a magnetic force acts and it is kept under such conditions that a force other than gravity and magnetic force is not applied to the sample. In this state, the powder is apparently solid but its characteristic flowability is not lost unless under the influences of a very strong magnet. In this state, the powder is contacted with electrodes and the electric resistance is determined according to a customary method. The spacing between the electrodes is correctly measured by using a micrometer. In this manner, the volume resistivity can be determined.

A most preferred method for fixing the sample powder between the electrodes is a method in which a magnet is disposed in parallel to the acting direction of gravity, the sample is attracted and fixed to the lower face of the magnet, and the facing electrodes are moved in the direction perpendicular to the magnetic force line. The adopted test conditions are as follows:

Electrodes: made of brass
Electrode thickness: 1 mm
Magnetic force: about 680 gauss on the surface
Electrode spacing: 1 to 3 mm
Applied voltage: 1,000 V The present invention will now be described in detail by reference to the following Examples that by no means limit the scope of the invention.

EXAMPLE 1

A yttrium iron oxide-dispersed resin solution comprising 1.1 parts by weight of yttrium iron oxide, 0.9 part by weight of rosin, 0.01 part by weight of Aniline Black, 5 parts by weight of acetone and 2 parts by weight of benzene was gradually poured into 400 parts by weight of water being agitated at 2000 rpm by means of a high speed agitator. The precipitated solid was recovered by filtration, washed with water and dried at 40° C. to obtain a toner composed of spherical particles having an average particle size of 20 μ, in which the yttrium iron oxide was predominantly distributed in the surface layer of each particle. It was found that the toner had a volume resistivity of $2.0 \times 10^{12}$ Ω-cm. By using the so formed toner development was conducted and the toner image was fixed in a Magnet Dry Copying Machine Model 191 (manufactured by 3M Co.). The obtained copy showed a very strong edge effect. Corax L (carbon black manufactured by Degussa Co.) was dry-blended into the above toner in an amount of 0.005 part by weight per part by weight of the toner. The so formed developer was found to have a volume resistivity of $4.1 \times 10^{8}$ Ω-cm. Development was conducted in the same manner as above by using the so obtained toner and the toner image was fixed under a pressure of 210 Kg/cm$^2$. A copied image having excellent clearness and fixing property was obtained.

EXAMPLE 2

An iron oxide-dispersed resin solution comprising 1 part by weight of triiron tetroxide (manufactured by Toyo Shikiso K. K.), 1 part by weight of EPICLON 4050 (epoxy resin manufactured by Dainippon Ink K. K.), 4 parts by weight of acetone and 4 parts by weight of ethyl acetate was gradually poured into 400 parts by weight of water being agitated at 2000 rpm by a high speed agitator. The precipitated solid was recovered by filtration, washed with water and dried at 40° C. to obtain a toner consisting of spherical particles having an average particle size of 15 μ, in which the iron oxide was predominatingly distributed in the surface layer of each particle. The so formed toner was found to have a volume resistivity of $5 \times 10^{9}$ Ω-cm and an oil absorption of 53.59.

Ultrafine silver powder (manufactured by Fujikura Kasei K. K.) having a particle size smaller than 2 μ was dry-blended into the so obtained toner in the amount of 0.01 part by weight per part by weight of the toner. The resulting developer was found to have a volume resistivity of $7.0 \times 10^{5}$ Ω-cm. In the same manner as described in Example 1, development and fixing under pressure were conducted to obtain a clear image having a high fixing power. The visible image could also be fixed according to the heat fixing method using a heating roller.

EXAMPLE 3

An iron oxide-dispersed resin solution comprising 1 part by weight of triiron tetroxide, 1 part by weight of Versamid 930 (polyamide resin manufactured by Daiichi General K. K.), 5 parts by weight of tetrahydrofuran and 4 parts by weight of n-butanol was gradually poured into 400 parts by weight of water being agitated at 2000 rpm by using a high speed agitator. The precipitated solid was recovered by filtration, washed with water and dried at 40° C. to obtain a toner consisting of spherical particles having an average particle size of 20 $\mu$, in which the iron oxide was predominantly distributed in the surface layer of each particle and a crater-like surface was formed on each particle. The toner was found to have a volume resistivity of $3.2 \times 10^8$ Ω-cm. Carbon black No. 30 (manufactured by Mitsubishi Kasei) was dry-blended into the so formed toner in an amount of 0.01 part by weight per part by weight of the toner. In the same manner as described in Example 1 development was conducted by using the so obtained developer and the formed visible image was fixed under a pressure of 210 Kg/cm$^2$ to obtain a clear copied image having a high fixing power.

The toner image could also be fixed by the heat fixing method using a heating roller.

EXAMPLE 4

A magnesium iron oxide-dispersed resin solution comprising 0.9 part by weight of magnesium iron oxide, 1.1 parts by weight of Himer SU-120 (styrene resin manufactured by Sanyo Kasei K. K.), 6 parts by weight of N,N-dimethylformamide and 2 parts by weight of chloroform was treated in the same manner as described in Example 2 to obtain a toner consisting of spherical particles having an average particle size of 20 $\mu$, in which the magnesium iron oxide was predominantly distributed in the surface layer of each particle. The toner was found to have a volume resistivity of $8.7 \times 10^7$ Ω-cm.

Corax L (carbon black manufactured by Degusa Co.) was dry-blended into the so formed toner in an amount of 0.005 part by weight per part by weight of the toner. By using the so obtained developer, development was conducted in a Magnet Dry Copying Machine Model 191 (manufactured by 3M Co.), and the toner image was fixed under 210 Kg/cm$^2$ by using two steel rollers to obtain a copied image having excellent clearness and fixing property.

The visible image could also be fixed by the heat fixing method using a heating roller.

EXAMPLE 5

A copper iron oxide-dispersed resin solution comprising 1 part by weight of copper iron oxide, 1 part by weight of cyclized rubber (manufactured by Sekisui Kasei K. K.), 0.01 part of $SiO_2$, 5 parts by weight of tetrahydropyran, 2 parts by weight of carbon tetrachloride and 1 part by weight of benzene was treated in the same manner as described in Example 2 to obtain a toner consisting of spherical particles having an average particle size of 15 $\mu$, in which the copper iron oxide was predominantly distributed in the surface layer of each particle. The toner was found to have a volume resistivity of $4.0 \times 10^{10}$ Ω-cm.

Super CF (carbon black manufactured by Asahi Carbon K. K.) was dry-blended into the so formed toner in an amount of 0.003 part by weight per part by weight of the toner. The so obtained developer was found to have a volume resistivity of $4 \times 10^8$ Ω-cm. In the same manner as described in Example 2, development was conducted by using the so obtained toner and fixation was carried out under a pressure of 210 Kg/cm$^2$ to obtain a copied image having excellent clearness and fixing property.

What we claim is:

1. A developer for electrostatic photography consisting essentially of a dry blend of (A) substantially spherical particles of a composition comprising a binder resin and a fine powder of a magnetic material dispersed in the binder resin so that the magnetic material is distributed predominantly in the surface layer of the spherical particles to form a crater-like rough surface; and (B) a finely divided solid conducting agent comprising electrically conductive carbon black and having a particle size smaller than 1/10 of the size of the spherical particles (A), the solid conducting agent being stuck to spherical particles (A) through the crater-like rough surfaces thereof without being embedded by the dry blending of spherical particles (A) and solid conducting agent (B), and being present in an amount of up to 2% by weight, based on spherical particles (A), the dry blend having a volume resistivity of not higher than $1 \times 10^{11}$ Ω-cm.

2. The developer as set forth in claim 1 wherein the fine powder of the magnetic material is composed of triiron tetroxide having an average particle size not larger than 500 millimicrons.

3. The developer of claim 2 wherein the fine powder of the magnetic material is selected from the group consisting of triiron tetroxide, diiron trioxide, zinc iron oxide, ytterium iron oxide, cadmium iron oxide, copper iron oxide, lead iron oxide, nickel iron oxide, neodium iron oxide, barium iron oxide, magnesium iron oxide, manganese iron oxide, lanthanum iron oxide, iron powder, cobalt powder, and nickel powder.

4. The developer as set forth in claim 1 wherein the binder resin medium is a synthetic resin which shows adhesiveness under the application of heat or pressure.

5. The developer as set forth in claim 1 wherein the synthetic resin is an epoxy resin.

6. The developer as set forth in claim 1 wherein the fine powder of the magnetic material is present in the spherical particles (A) in an amount of 20 to 80% by weight, based on the spherical particles (A).

7. The developer as set forth in claim 6 wherein the fine powder of the magnetic material is present in spherical particles (A) in an amount of 40 to 60% by weight, based on the spherical particles (A).

8. The developer as set forth in claim 1 wherein the spherical particles (A) have an oil absorption of 45 to 90.

9. The developer as set forth in claim 1 wherein the spherical particles (A) are those obtained by mixing the fine powder of the magnetic material with a dispersion or solution formed by dispersing or dissolving the binder resin in a liquid mixture of a water-miscible organic solvent and a water-immiscible organic solvent, and mixing the resulting mixture with an aqueous medium under high shearing agitation sufficient to cause granulation of the mixture, whereby the organic solvents in the resulting particles of said mixture are transferred into the aqueous medium.

10. The developer as set forth in claim 1 wherein the solid conducting agent is dry-blended in the spherical particles (A) in an amount of 0.1 to 2% by weight, based on the spherical particles (A).

11. The developer as set forth in claim 1 wherein spherical particles (A) additionally contain dyes, pigments and extender pigments having a particle size smaller than that of the fine powder of the magnetic material and present in an amount less than 50% by weight, based on the final composition.

12. The developer as set forth in claim 11 wherein the dyes, pigments and extender pigments are present in an amount less than 10% by weight, based on the final composition.

13. A process for the preparation of developers for electrostatic photography comprising:

(I) mixing a powdery magnetic material with a binder resin dissolved or dispersed in a liquid mixture of:
  (a) a water-miscible organic solvent, and
  (b) a water-immiscible organic solvent, the weight ratio of (a) to (b) ranging from 10:1 to 1:10;

(II) mixing the resulting mixture of (I) with an aqueous medium under strong shearing agitation sufficient to cause granulation of the mixture, thus transferring the organic solvents into the aqueous medium to form substantially spherical particles wherein the magnetic material is distributed predominantly in the surface layer portion of the spherical particles to form a crater-like rough surface;

(III) recovering the so formed particles;

(IV) water-washing the particles of (III);

(V) drying the particles of (IV) under such conditions that the resin binder is not substantially melted; and (VI) dry-blending into the particles of (V) a finely divided solid conducting agent having substantially a particle size of less than 1/10 the size of the particles of (V), the conducting agent being stuck to the particles of (V) through the crater-like rough surfaces thereof.

14. The process according to claim 13 wherein the resin concentration in the solution or dispersion of the binder resin in the liquid mixture of the water-miscible organic solvent and the water-immiscible solvent is 5 to 40% by weight.

15. The process of claim 14 wherein the resin concentration in the solution or dispersion of the binder resin in the liquid mixture of the water-miscible organic solvent and the water-immiscible solvent is 10 to 20% by weight.

16. The process of claim 13 wherein the binder resin is a synthetic resin which shows adhesiveness under the application of heat or pressure.

17. The process of claim 16 wherein the synthetic resin is an epoxy resin.

18. The process of claim 13 wherein the solid conducting agent is carbon black, aluminum powder, copper powder, or silver powder.

19. The process of claim 13 wherein the solid conducting agent is present in an amount of up to 2% by weight, based on the spherical particles.

20. The process of claim 13 wherein the solid conducting agent is present in an amount of 0.1 to 2% by weight, based on the spherical particles.

21. The process of claim 13 wherein the powdery magnetic material has a particle size of less than 500 mμ and is selected from the group consisting of triiron tetroxide, diiron trioxide, zinc iron oxide, ytterium iron oxide, cadmium iron oxide, copper iron oxide, lead iron oxide, nickel iron oxide, neodium iron oxide, barium iron oxide, magnesium iron oxide, lanthanum iron oxide, manganese iron oxide, iron powder, cobalt powder, and nickel powder.

* * * * *

UNITED STATES PATENT AND TRADEMARK OFFICE

CERTIFICATE OF CORRECTION

PATENT NO. : 4,082,681

DATED : April 4, 1978

INVENTOR(S) : Takayama, et al

It is certified that error appears in the above—identified patent and that said Letters Patent is hereby corrected as shown below:

After item /73/ on the first page, delete "Assignee: Mita Industrial Company" and insert --Assignee: Mita Industrial Company Limited--.

The attached Columns 9 thru 12 should be insert immediately following columns 7 & 8. (This correction applys to the Grant, exclusively.)

Signed and Sealed this

*Eighteenth* Day of *March 1980*

[SEAL]

*Attest:*

SIDNEY A. DIAMOND

*Attesting Officer*

*Commissioner of Patents and Trademarks* wherein A stands for the amount (g) of linseed oil added dropwise to the sample and B denotes the amount (g) of the sample.

According to the present invention, the so prepared spherical particles (A) having a crater-like surface are dry-blended with a finely divided solid conducting agent (B) having a particle size smaller than 1/10 of the size of the sphrical particles (A), and the solid conducting agent (B) is stuck to the spherical particles (A) through the crater-like rough surfaces thereof. By this step, the volume resistivity of the resulting dry blend is thus controlled below $1 \times 10^{11}$ Ω-cm.

As the finely divided conducting agent (B), there can be used, for example, carbon black, aluminum powder, copper powder, silver powder and the like. This finely divided conducting agent (g) is dry-blended in such an amount that the conducting agent (B) is stuck to the rough surfaces of the spherical particles (A) in an amount of up to 2% by weight, especially 0.1 to 2% by weight, based on the spherical particles (A).

The fact that in the developer of the present invention, though both the components (A) and (B) are merely dry-blended, the fine powder of the conducting agent (B) is hardly separated from the surfaces of the spherical particles (A) is readily understood from the Examples given hereinafter, which demonstrate that no contamination is caused on the background in the development step. Still further, the fact that the developer of the present invention consists essentially of a dry blend of both components (A) and (B) can be confirmed by the experimental result that when the developer of the present invention is subjected to water sieving using an aqueous medium containing a surface active agent, the spherical particles (A) can be separated from a dispersion of the finely divided conducting agent (B).

The developer of the present invention can be advantageously applied to various electrostatic photographic processes. For example, the developer of the present invention can be applied with ease in the form of a magnetic brush to an electrostatic image formed on a photoconductive layer of zinc oxide, CdS or the like. The toner image formed by development can easily be fixed under the application of heat and/or pressure as it is developed or after it has been transferred onto a suitable transfer paper.

The test method and apparatus used for determining the volume resistivity of the developer in the present invention will now be described.

Test Method

A sample developer is maintained in a region where a magnetic force acts and it is kept under such conditions that a force other than gravity and magnetic force is not applied to the sample. In this state, the powder is apparently solid but its characteristic flowability is not lost unless under the influences of a very strong magnet. In this state, the powder is contacted with electrodes and the electric resistance is determined according to a customary method. The spacing between the electrodes is correctly measured by using a micrometer. In this manner, the volume resistivity can be determined.

A most preferred method for fixing the sample powder between the electrodes is a method in which a magnet is disposed in parallel to the acting direction of gravity, the sample is attracted and fixed to the lower face of the magnet, and the facing electrodes are moved in the direction perpendicular to the magnetic force line. The adopted test conditions are as follows:

Electrodes: made of brass
Electrode thickness: 1 mm
Magnetic force: about 680 gauss on the surface
Electrode spacing: 1 to 3 mm
Applied voltage: 1,000 V The present invention will now be described in detail by reference to the following Examples that by no means limit the scope of the invention.

EXAMPLE 1

A yttrium iron oxide-dispersed resin solution comprising 1.1 parts by weight of yttrium iron oxide, 0.9 part by weight of rosin, 0.01 part by weight of Aniline Black, 5 parts by weight of acetone and 2 parts by weight of benzene was gradually poured into 400 parts by weight of water being agitated at 2000 rpm by means of a high speed agitator. The precipitated solid was recovered by filtration, washed with water and dried at 40° C. to obtain a toner composed of spherical particles having an average particle size of 20 μ, in which the yttrium iron oxide was predominantly distributed in the surface layer of each particle. It was found that the toner had a volume resistivity of $2.0 \times 10^{12}$ Ω-cm. By using the so formed toner development was conducted and the toner image was fixed in a Magnet Dry Copying Machine Model 191 (manufactured by 3M Co.). The obtained copy showed a very strong edge effect. Corax L (carbon black manufactured by Degussa Co.) was dry-blended into the above toner in an amount of 0.005 part by weight per part by weight of the toner. The so formed developer was found to have a volume resistivity of $4.1 \times 10^{8}$ Ω-cm. Development was conducted in the same manner as above by using the so obtained toner and the toner image was fixed under a pressure of 210 Kg/cm². A copied image having excellent clearness and fixing property was obtained.

EXAMPLE 2

An iron oxide-dispersed resin solution comprising 1 part by weight of triiron tetroxide (manufactured by Toyo Shikiso K. K.), 1 part by weight of EPICLON 4050 (epoxy resin manufactured by Dainippon Ink K. K.), 4 parts by weight of acetone and 4 parts by weight of ethyl acetate was gradually poured into 400 parts by weight of water being agitated at 2000 rpm by a high speed agitator. The precipitated solid was recovered by filtration, washed with water and dried at 40° C. to obtain a toner consisting of spherical particles having an average particle size of 15 μ, in which the iron oxide was predominatingly distributed in the surface layer of each particle. The so formed toner was found to have a volume resistivity of $5 \times 10^{9}$ Ω-cm and an oil absorption of 53.59.

Ultrafine silver powder (manufactured by Fujikura Kasei K. K.) having a particle size smaller than 2 μ was dry-blended into the so obtained toner in the amount of 0.01 part by weight per part by weight of the toner. The resulting developer was found to have a volume resistivity of $7.0 \times 10^{5}$ Ω-cm. In the same manner as described in Example 1, development and fixing under pressure were conducted to obtain a clear image having a high fixing power. The visible image could also be fixed according to the heat fixing method using a heating roller.

EXAMPLE 3

An iron oxide-dispersed resin solution comprising 1 part by weight of triiron tetroxide, 1 part by weight of Versamid 930 (polyamide resin manufactured by Daiichi General K. K.), 5 parts by weight of tetrahydrofuran and 4 parts by weight of n-butanol was gradually poured into 400 parts by weight of water being agitated at 2000 rpm by using a high speed agitator. The precipitated solid was recovered by filtration, washed with water and dried at 40° C. to obtain a toner consisting of spherical particles having an average particle size of 20 μ, in which the iron oxide was predominantly distributed in the surface layer of each particle and a crater-like surface was formed on each particle. The toner was found to have a volume resistivity of $3.2 \times 10^8$ Ω-cm. Carbon black No. 30 (manufactured by Mitsubishi Kasei) was dry-blended into the so formed toner in an amount of 0.01 part by weight per part by weight of the toner. In the same manner as described in Example 1 development was conducted by using the so obtained developer and the formed visible image was fixed under a pressure of 210 Kg/cm² to obtain a clear copied image having a high fixing power.

The toner image could also be fixed by the heat fixing method using a heating roller.

EXAMPLE 4

A magnesium iron oxide-dispersed resin solution comprising 0.9 part by weight of magnesium iron oxide, 1.1 parts by weight of Himer SU-120 (styrene resin manufactured by Sanyo Kasei K. K.), 6 parts by weight of N,N-dimethylformamide and 2 parts by weight of chloroform was treated in the same manner as described in Example 2 to obtain a toner consisting of spherical particles having an average particle size of 20 μ, in which the magnesium iron oxide was predominantly distributed in the surface layer of each particle. The toner was found to have a volume resistivity of $8.7 \times 10^7$ Ω-cm.

Corax L (carbon black manufactured by Degusa Co.) was dry-blended into the so formed toner in an amount of 0.005 part by weight per part by weight of the toner. By using the so obtained developer, development was conducted in a Magnet Dry Copying Machine Model 191 (manufactured by 3M Co.), and the toner image was fixed under 210 Kg/cm² by using two steel rollers to obtain a copied image having excellent clearness and fixing property.

The visible image could also be fixed by the heat fixing method using a heating roller.

EXAMPLE 5

A copper iron oxide-dispersed resin solution comprising 1 part by weight of copper iron oxide, 1 part by weight of cyclized rubber (manufactured by Sekisui Kasei K. K.), 0.01 part of $SiO_2$, 5 parts by weight of tetrahydropyran, 2 parts by weight of carbon tetrachloride and 1 part by weight of benzene was treated in the same manner as described in Example 2 to obtain a toner consisting of spherical particles having an average particle size of 15 μ, in which the copper iron oxide was predominantly distributed in the surface layer of each particle. The toner was found to have a volume resistivity of $4.0 \times 10^{10}$ Ω-cm.

Super CF (carbon black manufactured by Asahi Carbon K. K.) was dry-blended into the so formed toner in an amount of 0.003 part by weight per part by weight of the toner. The so obtained developer was found to have a volume resistivity of $4 \times 10^8$ Ω-cm. In the same manner as described in Example 2, development was conducted by using the so obtained toner and fixation was carried out under a pressure of 210 Kg/cm² to obtain a copied image having excellent clearness and fixing property.

What we claim is:

1. A developer for electrostatic photography consisting essentially of a dry blend of (A) substantially spherical particles of a composition comprising a binder resin and a fine powder of a magnetic material dispersed in the binder resin so that the magnetic material is distributed predominantly in the surface layer of the spherical particles to form a crater-like rough surface; and (B) a finely divided solid conducting agent comprising electrically conductive carbon black and having a particle size smaller than 1/10 of the size of the spherical particles (A), the solid conducting agent being stuck to spherical particles (A) through the crater-like rough surfaces thereof without being embedded by the dry blending of spherical particles (A) and solid conducting agent (B), and being present in an amount of up to 2% by weight, based on spherical particles (A), the dry blend having a volume resistivity of not higher than $1 \times 10^{11}$ Ω-cm.

2. The developer as set forth in claim 1 wherein the fine powder of the magnetic material is composed of triiron tetroxide having an average particle size not larger than 500 millimicrons.

3. The developer of claim 2 wherein the fine powder of the magnetic material is selected from the group consisting of triiron tetroxide, diiron trioxide, zinc iron oxide, ytterium iron oxide, cadmium iron oxide, copper iron oxide, lead iron oxide, nickel iron oxide, neodium iron oxide, barium iron oxide, magnesium iron oxide, manganese iron oxide, lanthanum iron oxide, iron powder, cobalt powder, and nickel powder.

4. The developer as set forth in claim 1 wherein the binder resin medium is a synthetic resin which shows adhesiveness under the application of heat or pressure.

5. The developer as set forth in claim 1 wherein the synthetic resin is an epoxy resin.

6. The developer as set forth in claim 1 wherein the fine powder of the magnetic material is present in the spherical particles (A) in an amount of 20 to 80% by weight, based on the spherical particles (A).

7. The developer as set forth in claim 6 wherein the fine powder of the magnetic material is present in spherical particles (A) in an amount of 40 to 60% by weight, based on the spherical particles (A).

8. The developer as set forth in claim 1 wherein the spherical particles (A) have an oil absorption of 45 to 90.

9. The developer as set forth in claim 1 wherein the spherical particles (A) are those obtained by mixing the fine powder of the magnetic material with a dispersion or solution formed by dispersing or dissolving the binder resin in a liquid mixture of a water-miscible organic solvent and a water-immiscible organic solvent, and mixing the resulting mixture with an aqueous medium under high shearing agitation sufficient to cause granulation of the mixture, whereby the organic solvents in the resulting particles of said mixture are transferred into the aqueous medium.

10. The developer as set forth in claim 1 wherein the solid conducting agent is dry-blended in the spherical particles (A) in an amount of 0.1 to 2% by weight, based on the spherical particles (A).